US005865446A

United States Patent [19]

Kobylenski et al.

[11] Patent Number: 5,865,446

[45] Date of Patent: Feb. 2, 1999

[54] ARTICULATED TWO-SECTION SNOW BOARD

[76] Inventors: Mark J. Kobylenski, 62 Eli Bunker Rd., Goshen, Conn. 06756; David M. Dupill, 58 Parker Hill Rd., Norfolk, Conn. 06058

[21] Appl. No.: 823,197

[22] Filed: Mar. 24, 1997

Related U.S. Application Data

[63] Continuation-in-part of Ser. No. 658,505, Jun. 6, 1996, Pat. No. 5,618,051.

[51] Int. Cl.[6] ..... B62B 13/04

[52] U.S. Cl. ..... 280/14.2; 280/17; 280/20; 280/22; 280/603; 280/606

[58] Field of Search ..... 280/14.2, 20, 845, 280/15, 16, 17, 22, 603, 601, 606, 607, 87.041, 87.042; 441/74, 68, 65

[56] References Cited

U.S. PATENT DOCUMENTS

| | | | |
|---|---|---|---|
| 2,390,181 | 12/1945 | Sartou . | |
| 2,442,918 | 6/1948 | Caughrean . | |
| 2,592,116 | 4/1952 | Caughrean . | |
| 3,372,944 | 3/1968 | Lauritzen . | |
| 4,138,128 | 2/1979 | Criss . | |
| 4,163,565 | 8/1979 | Weber . | |
| 4,175,759 | 11/1979 | Strunk . | |
| 4,194,753 | 3/1980 | Schrishuhn . | |
| 4,221,394 | 9/1980 | Campbell . | |
| 4,261,778 | 4/1981 | Albrigtsen et al. | 156/245 |
| 4,652,007 | 3/1987 | Dennis . | |
| 4,725,069 | 2/1988 | Stampacchia . | |
| 5,021,017 | 6/1991 | Ott . | |
| 5,028,068 | 7/1991 | Donovan . | |
| 5,249,816 | 10/1993 | Southworth . | |
| 5,411,282 | 5/1995 | Shannon | 280/606 |
| 5,618,051 | 4/1997 | Kobylenski et al. | 280/14.2 |

*Primary Examiner*—Eric D. Culbreth
*Attorney, Agent, or Firm*—Handal & Morofsky

[57] ABSTRACT

An articulated two-section snowboard has a first and second section joined together for twisting and oscillation. Each section has an upper surface, a lower surface and an outer portion and an inner portion. A flexible connector joins the inner portions of the first and second sections and a pair of bindings for securing the feet of a user to the upper surface of the first and second sections.

24 Claims, 10 Drawing Sheets

ARTICULATED TWO-SECTION SNOW BOARD

CROSS-REFERENCE TO RELATED APPLICATIONS

This application is a continuation-in-part of U.S. patent application Ser. No. 08/658,505 of Mark J. Kobylenyski et al., filled Jun. 6, 1996 now U.S. Pat. No. 5,618,051 and entitled "ARTICULATED TWO-SECTION SNOWBOARD".

FIELD OF THE INVENTION

This invention relates to a snowboard comprised of independent front and back sections joined together in a universal fashion to permit relative axial twisting and horizontal and vertical pivoting between the sections.

BACKGROUND OF THE INVENTION

In the past, snowboards have comprised a single surface, with upwardly curved tips on each end having various degrees of width and rigidity. Such a snowboard has been equipped with forward and rear bindings for attaching the user's boots to the snowboard.

Prior snowboards have been limited in their ability to make sharp turns and to smoothly proceed over uneven surface. The rigid elongated nature of prior snowboards has made it awkward to store and transport them and also limits the user in tricks or aerial acrobatics.

When utilizing a chair lift, prior rigid snowboards tend to angle off to one side, intruding into the space and skis of co-passengers.

The rigidity of prior snowboards also presents a challenge to the user in returning to an upright position in the event the user should fall.

SUMMARY OF THE INVENTION

The articulated two-section snowboard relates to a snowboard comprised of separate front and rear sections joined together in a manner that allows a user to move each section with respect to the other. The joining of the sections allows for articulation and twisting of each section. Each section also has a binding for one foot.

In a preferred embodiment, the joint between the two sections is achieved by one or more flexible connectors such as straps, the front end of each strap being attached to the rear end of the front section and the rear end of the strap being attached to the front end of the rear section. A spacer may be attached to the strap to prevent the rear section from riding up over the front section. Quick connect and disconnect latches may be provided to separate the sections for purposes of storage, transportation, mobility or replacement of a section.

BRIEF DESCRIPTION OF THE DRAWINGS

Further objects and features of the articulated two-section snowboard will be clear to those skilled in the art, from a review of the following specifications and drawings, all of which present a non-limiting form of the articulated two-section snowboard. In the drawings.

DETAILED DESCRIPTION OF THE PREFERRED EMBODIMENT

Figure 1:
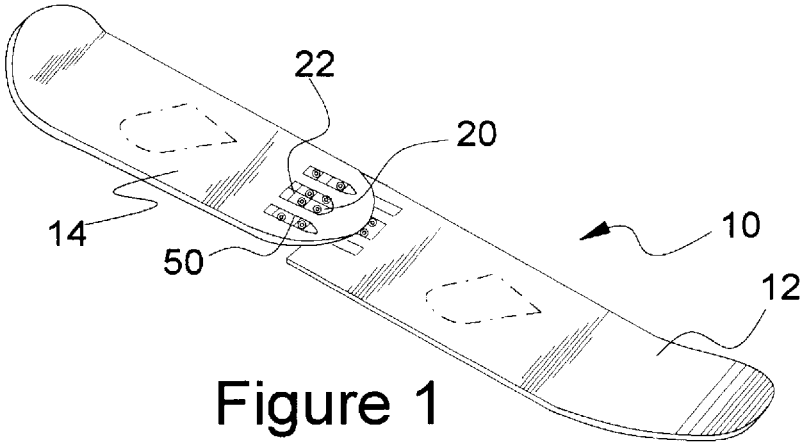
FIG. 1 is a perspective view of the preferred embodiment of the articulated two-section snowboard, showing in phantom, the areas on which bindings may be mounted.

An articulated two-section snowboard is shown in FIG. 1 and generally designated 10. It comprises a front section 12 and a rear section 14. As shown in FIG. 1, the front tip of the front section is curved upwardly in the manner of a conventional snowboard tip. The front tip of the rear section is curved upwardly as shown in FIG. 4, but not to the extent of the front section tip.

As shown in FIG. 1, the rear section has a rounded triangular opening as generally designated 20 on the center line of the rear section. Extending through the opening 20 is a central connecting strap 22. Strap 22 is attached at either end to the front and rear sections. Strap 22 would be preferably of a natural rubber and may have the thickness of about ¼" or better.

Figure 4:
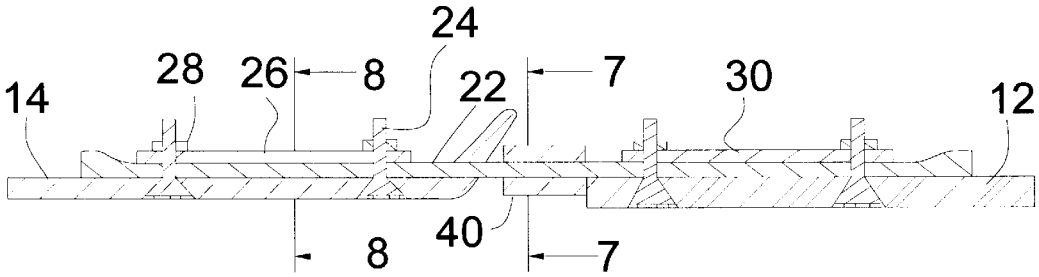
FIG. 4 is an enlarged fragmentary sectional view taken on the line 4—4 of FIG. 2.

Strap 22 as shown in FIG. 4 is substantially non-rigid and secured to the respective sections of the articulated two-section snowboard by flathead bolts 24 which are preferably molded into the snowboard to achieve a smooth surface. Bolts 24 extend through apertures in strap 22 and receive respective openings of a rear clamping plate 26 which is perforated at opposite ends of the plate 26. A nut 28 is threaded onto bolt 24 to compress strap 22 between plate 26 and rear section 14 of the articulated snowboard in a secured fashion.

Figure 7:
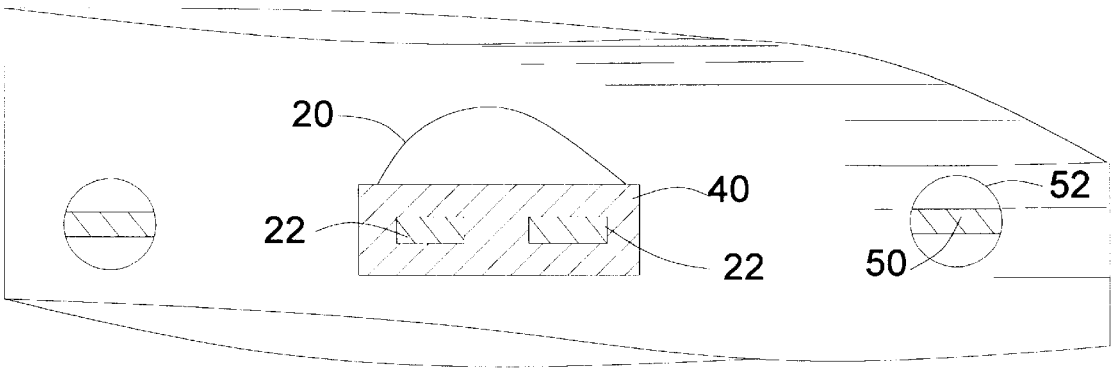
FIG. 7 is a fragmentary sectional view taken on the line 7—7 of FIG. 4.
Figure 8:
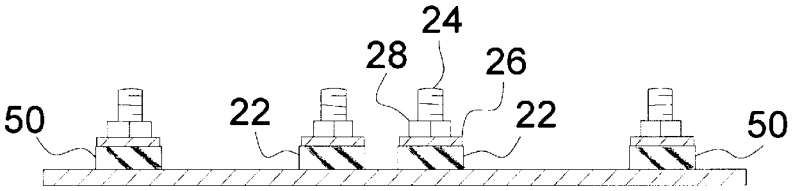
FIG. 8 is a sectional view taken on the line 8—8 of FIG. 4.

FIG. 4 shows a front clamping plate 30, attached with bolt 24 which is molded into the rear of the front section of the articulated two-section snowboard. Plate 30 clamps strap 22 as shown. A tubular spacer 40 is provided. Preferably, as shown in FIG. 7, spacer 40 has an opening for strap 22. Spacer 40 may be of resilient plastic or rubber and can engage with its opposite ends, the adjacent portions of the front and rear sections. Spacer 40 attempts to keep the rear section of the articulated two-section snowboard from riding up over the front section.

Figure 2:
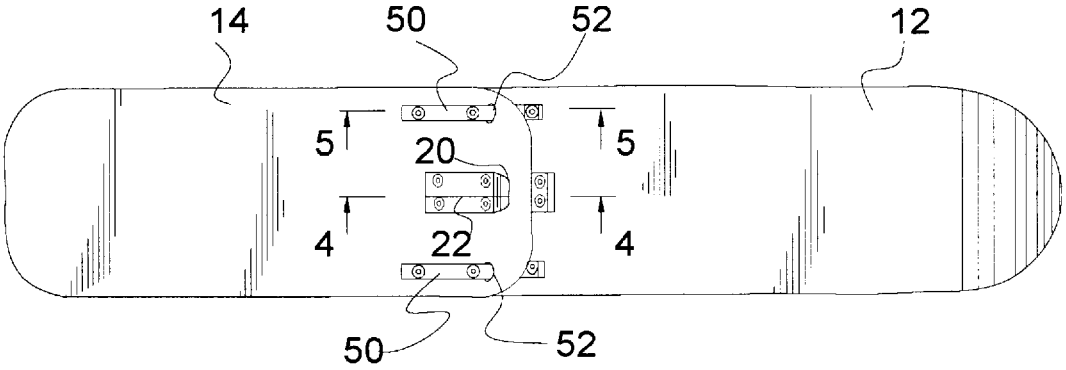
FIG. 2 is a top view plan.
Figure 3:
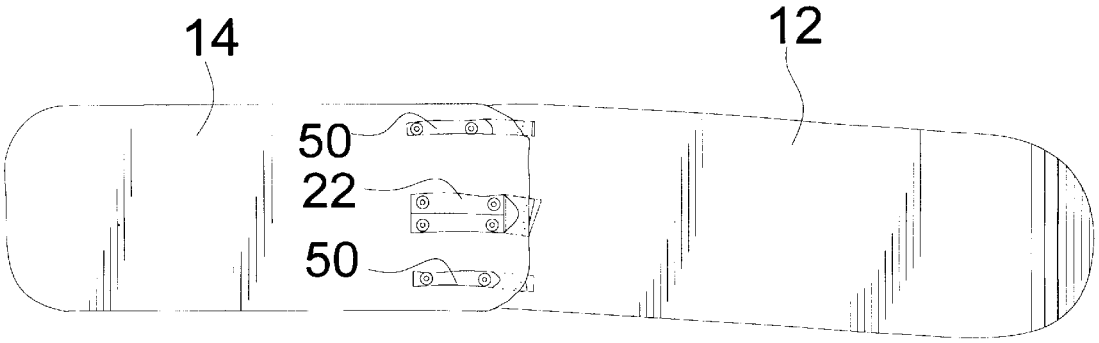
FIG. 3 is a plan view of an articulated two-section snowboard as it would appear while carving a turn.
Figure 5:
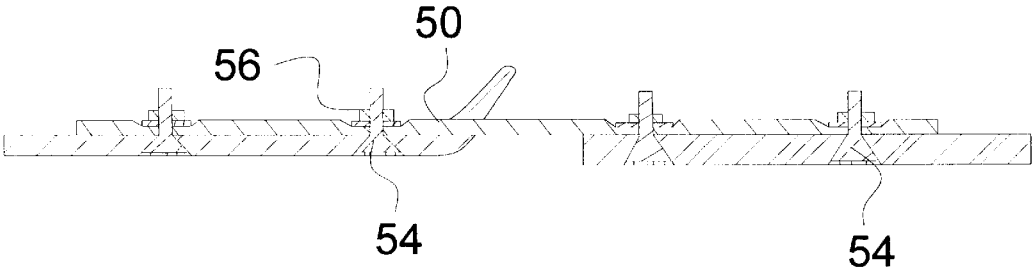
FIG. 5 is a sectional view taken on the line 5—5 of FIG. 2.
Figure 6:
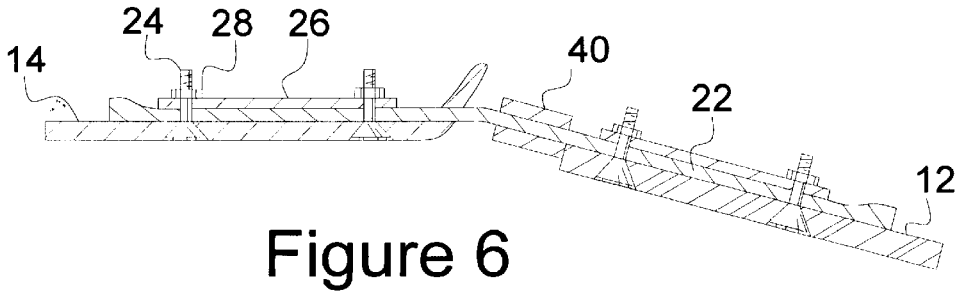
FIG. 6 is a sectional view comparable to FIG. 4, but showing fragmentarily in section the articulated two-section snowboard as it would appear going over a mogul or other uneven surface.

As shown in FIG. 2 longitudinal side connecting straps 50 are provided in the preferred embodiment and pass through openings 52, respectively along lines spaced outward from strap 22. Straps 50, as shown in FIG. 5, have the forward and rearward ends firmly secured to the front and rear section of the snowboard respectively. As shown in FIG. 5, bolts 54, are preferably molded into the proximal ends of the front and rear sections of the snowboard. A nut 56 (FIG. 5) carrying a washer would be tightened to clamp straps 50 between the various points to properly secure the straps 50. The purpose of straps 50 and strap 22 are foremost to connect the front and rear sections, with an added feature of dexterity.

Figure 9:
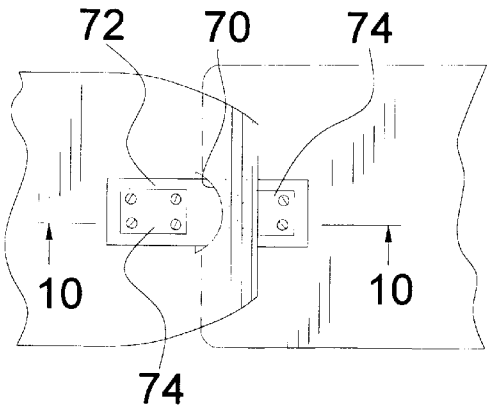
FIG. 9 is a fragmentary view of a modified connection between the front and rear section.
Figure 10:
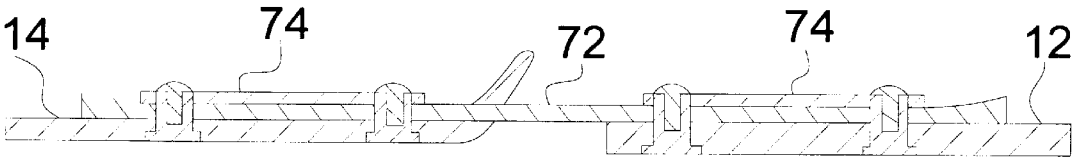
FIG. 10 is an enlarged fragmentary sectional view taken on the line 10—10 of FIG. 9.

A further embodiment of the articulated two-section snowboard is shown in FIG. 9, wherein the opening 70, in the tip of the rear section, is enlarged and receives a board connecting strap 72, clamped to the respective front and rear sections at its opposite ends by top clamping plates 74. Strap 72 provides further flexibility for the accomplished and extreme snowboard user.

The FIG. 1 embodiment is preferred in that desirable flexibility of the connecting joint can be achieved with control of the extent of pivoting.

Figure 11:
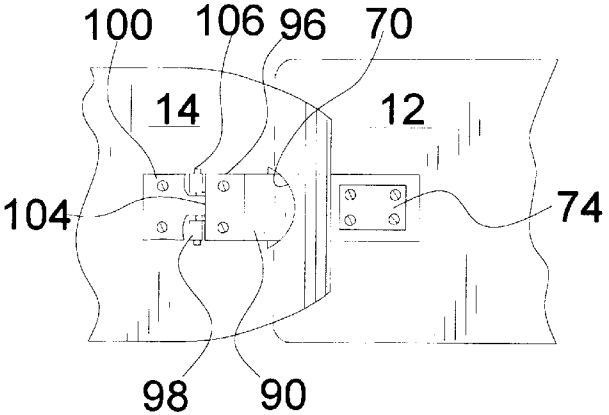
FIG. 11 is a fragmentary view of a further modification.

FIG. 11 modification includes means for quick-detachment and quick-attachment of the sections. In FIG. 11, strap 90 passes through opening 70. Strap 90 is secured to the rear of the front section by plate 74 and fasteners similar to that of the FIG. 9 embodiment. As shown in FIG. 11 the rear end of strap 90 in secured to a hinge plate 96. Secured to the front end of the rear section is a mating hinge plate 100. A removable hinge pin 106 can be inserted through the aligned hinges of plate 96 and plate 100 to allow for the front and rear sections to be separated or connected.

Figure 13:
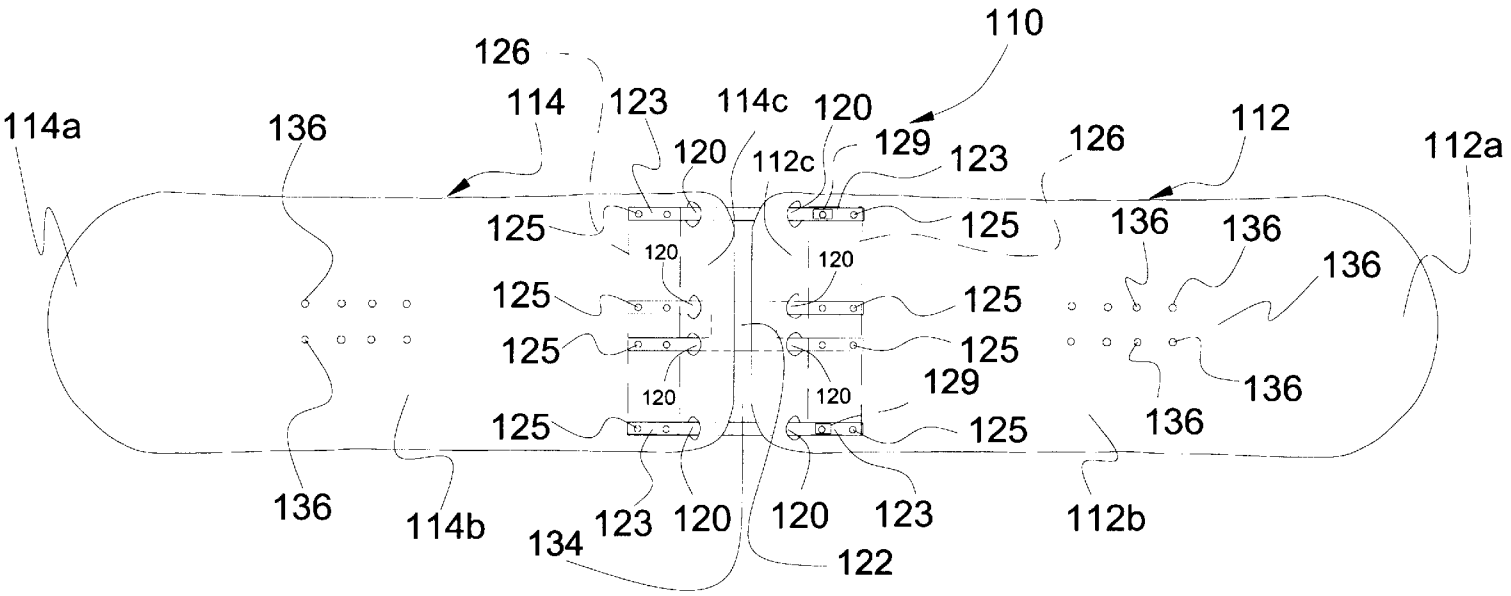
FIG. 13 is top plan view of an alternative embodiment of the present invention.
Figure 14:
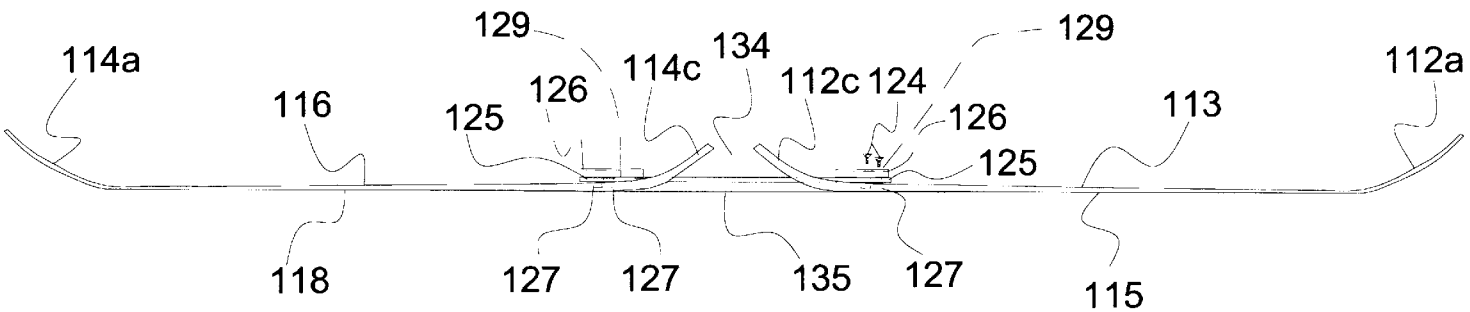
FIG. 14 is a side view of the FIG. 13 embodiment.
Figure 15:
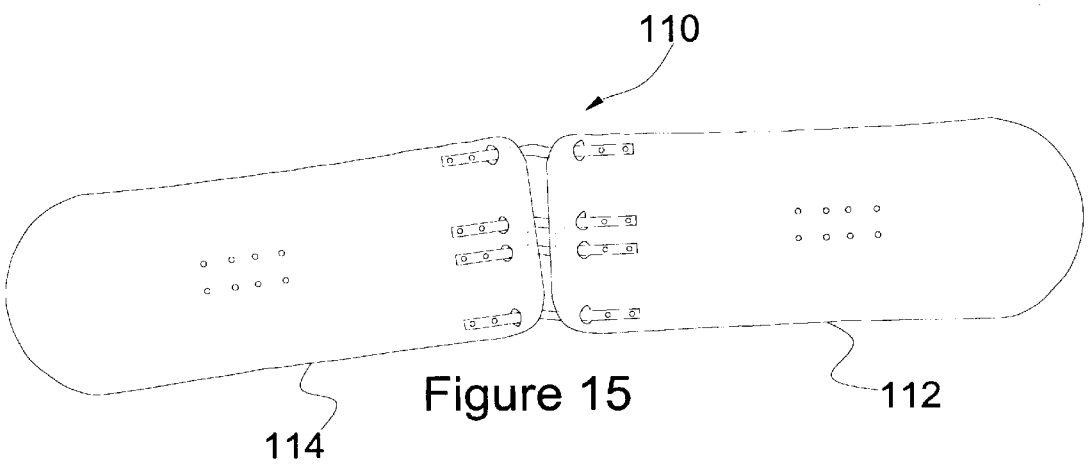
FIG. 15 is a top plan view illustrating the flexibility of the present invention.
Figure 16:
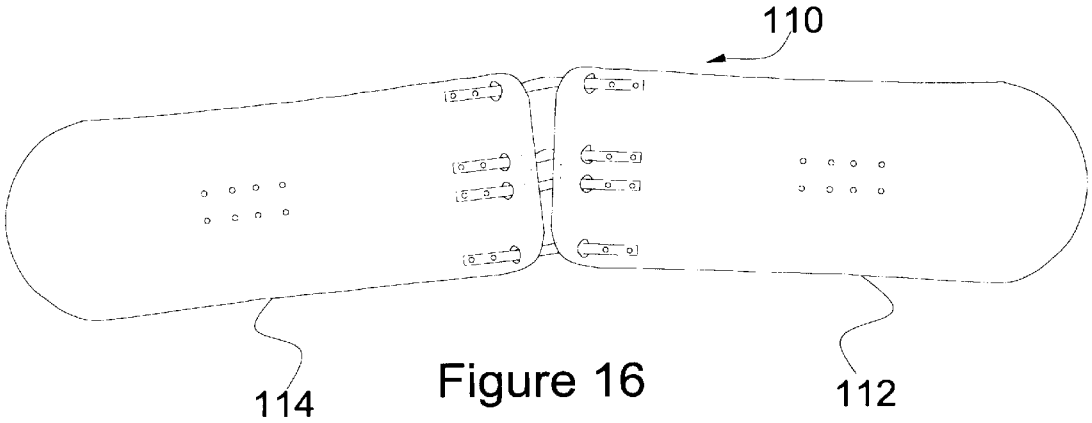
FIG. 16 is a top plan view illustrating the flexibility of the present invention.
Figure 17:
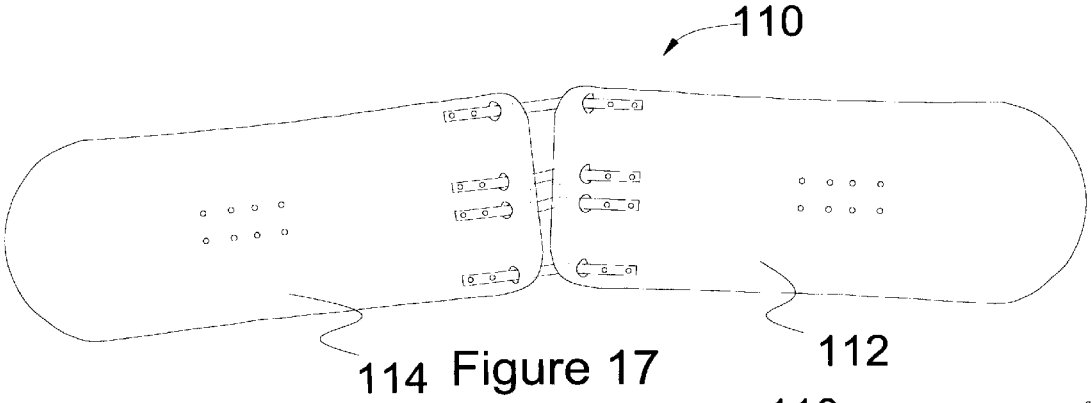
FIG. 17 is a top plan view illustrating the flexibility of the present invention.
Figure 18:
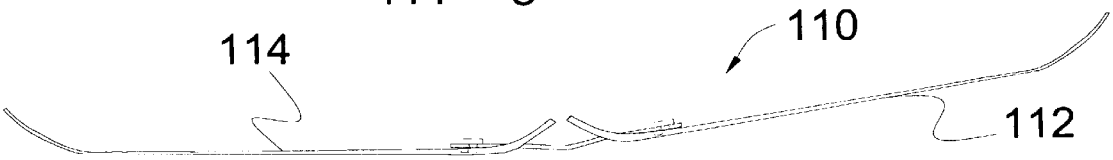
FIG. 18 is a side view illustrating the flexibility of the present invention.
Figure 19:
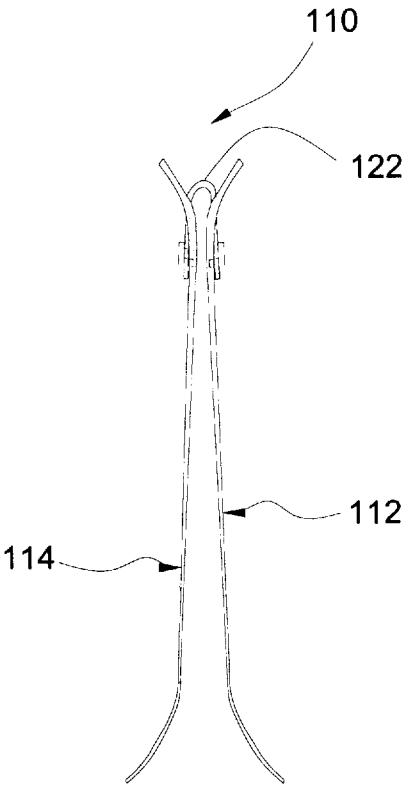
FIG. 19 is a side view illustrating the flexibility of the present invention.

In FIGS. 13 and 14 an alternative embodiment of the present invention is illustrated. Generally, similar components or parts performing analogous, corresponding or identical functions to those of the FIG. 1 embodiment are numbered herein with numerals that differ from the FIG. 1 embodiment by multiples of one hundred.

Referring to FIG. 13, an articulated two-section snowboard 110 is shown. Snowboard 110 comprises a front snowboard section 112 and a rear snowboard section 114. Snowboard section 112 has a front portion 112*a*, a mid-section 112*b*, a rear section 112*c*, an upper surface 113 and a lower surface 115.

Similarly, snowboard section 114 has a outer portion 114*a*, a mid section 114*b*, a inner section 114*c*, an upper surface 116 and a lower surface 118.

As can be seen from FIG. 13, snowboard sections 112 and 114 are configured to have their respective end portions 112*c* and 114*c* facing each other. Rear end portions 112*c* and 114*c* are configured to have a plurality of openings 120 which are in horizontal alignment with each other when end portions 112*c* and 114*c* are facing each other.

Snowboard sections 112 and 114 are secured to each other by a connecting strap 122 and a pair of straps 123. Connecting strap 122 and straps 123 pass through openings 120 and are secured to the upper surfaces 113 and 116 of snowboard sections 112 and 114 by plurality of bolts 124.

Straps 122 and 123 are constructed out of a reinforced rubber having a high tensile strength along with a substantial amount of flexibility. Alternatively, connection straps 122 and 123 may be constructed out of a durable and flexible natural or synthetic polymeric material having a high tensile strength along with a substantial amount of flexibility. Straps 122 and 123 are manufactured to be resilient to substantial temperature ranges that may be encounter while using the snowboard.

Bolts 124 pass through a plurality of openings 125 in connecting strap 122 and straps 123 and are then received into a plurality of threaded openings 127. Openings 125 can be chamfered to allow the head of bolts 124 to be flushly mounted to the surface of straps 122 and 123. In the alternative, openings 125 need not be chamfered.

Threaded openings 127 are positioned in the upper surfaces 113 and 116 of snowboard sections 112 and 114. For rigid securement, threaded openings 127 are provided by a grommet insert or the board itself may be threaded.

Referring now to FIG. 14, rear sections 112*c* and 114*c* are of a larger thickness than the other portions of snowboard sections 112 and 114. This increased thickness allows for a deep threaded opening 127, which in turn provides a strong securement of bolts 124 into the upper surfaces 113 and 116.

Alternatively, and as illustrated by the dashed lines in FIGS. 13 and 14, a series of connecting plates 126 or caps 129 may be secured by bolts 124 to the surface of straps 122 and 123. Alternatively, the plates 126 may be replaced by caps 129 as illustrated by the dashed lines of FIG. 14. Connecting plate 126 is preferably manufactured out of aluminum, stainless steel or a resinous polymer material and is configured to cover each opening used to secure straps 122 and 123 to snowboard sections 112 and 114. Connecting plates 126 will provide a more uniform securement of straps 122 and 123. Similarly, connecting plates 126 can be recessed so as to allow bolts 124 to remain flush with the surface of plate 126. In the alternative plates 126 or caps 129 need not be recessed.

In addition, sections 112*c* and 114*c* are curved upwardly to maintain straps 122 and 123 above the ground surface 135. Sections 112*a* and 114*a* are also curved upwardly and are configured to curve upwardly in the manner of a conventional snowboard tip.

As illustrated the curvature of outer portions 112*a* and 114*a* is of radius larger than the radius of curvature of portions 112*c* and 114*c*. However, portions 112*a* and 114*a* extend higher upwardly to facilitate movement of snowboard 110 through a path of various surface types and conditions.

Referring back to FIG. 13, connecting strap 122 is configured to have an H shaped configuration and is secured above the center line 132 of snowboard 110. In contrast, straps 123 are secured closer to the edges of snowboard 110.

Snowboard sections 112 and 114 are also provided with a series of openings 136. Openings 136 facilitate the securement of a user to snowboard 110, as will be discussed below.

The securement of connecting strap 122 and straps 123 allow for an opening 134 to be disposed between rear sections 112*c* and 114*c*. Opening 134 and the flexibility of straps 122 and 123 allow the user to position snowboard sections 112 and 114 in a variety of positions with respect to each other as illustrated in FIGS. 15–19. Such positions are clearly not obtainable with conventional snowboard technology. Alternatively and as illustrated by the dashed lines in FIG. 13, connecting strap 122 may be configured to completely cover opening 134. In this configuration connecting strap 122 would pass through an elongated opening 120 also illustrated by dashed lines.

Figure 20:
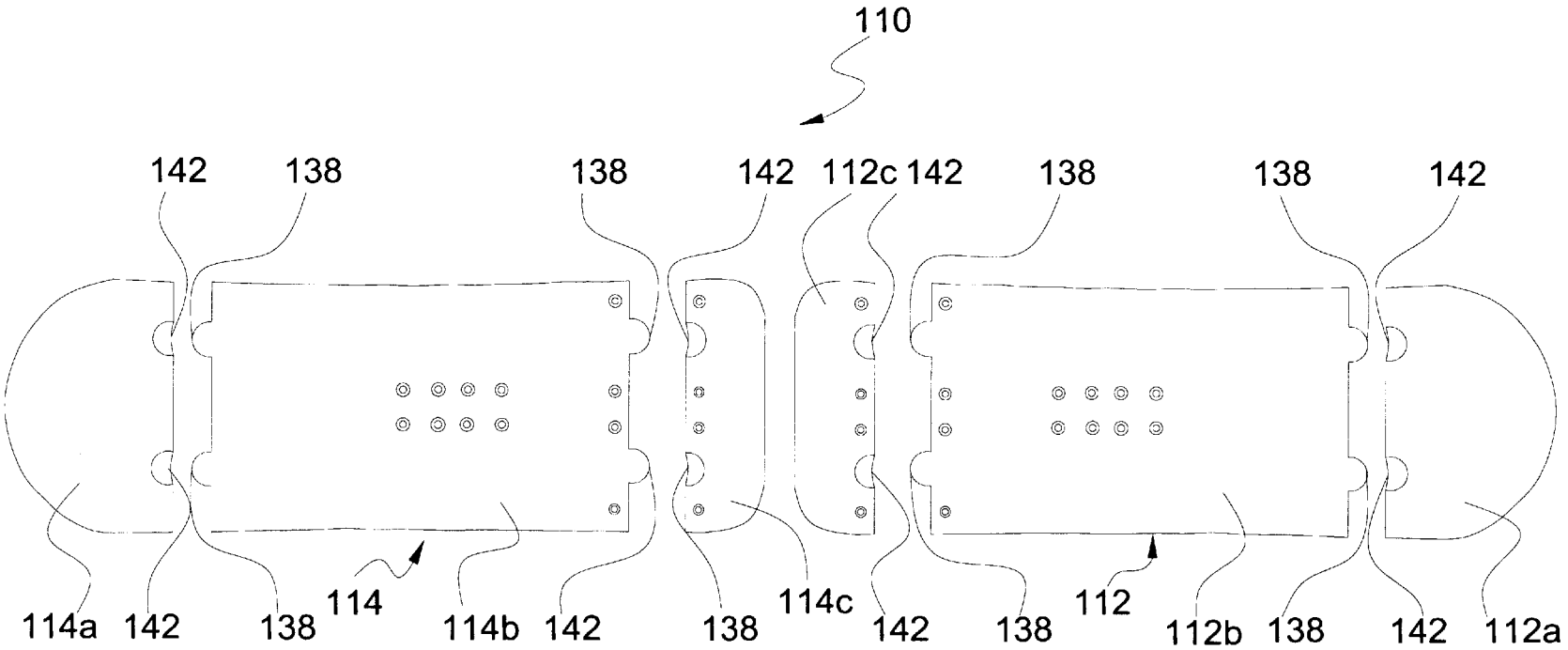
FIG. 20 is an exploded view illustrating the construction of the present invention.

Referring now to FIG. 20, an exploded view of snowboard sections 112 and 114 are illustrated. Front portions 114*a* and 112*a,* and rear portions 112*c* and 114*c* are manufactured out of acrylonitrile butadiene strene resin or as commonly referred to in the industry as ABS. Portions 112*a*, 114*a*, 112*c* and 114*c* comprise ABS and are configured to curve upwardly in the manner of a conventional snowboard tip and tail.

Mid sections 112*b* and 114*b* are comprised of a multiple layered wood laminate to provide stability and rigidness to mid-sections 112*b* and 114*b*. Moreover, mid-sections 112*b* and 114*b* are less likely to compress in thickness, such as other conventional ski technology such as foam core injection or a combination of fiberglass laminates and a foam core injection. Alternatively, foam core or solid polymer resin structures can replace the wood laminate structure illustrated.

Mid sections 112*b* and 114*b* are secured to front and rear portions 112*a*, 112*c*, 114*a* and 114*c* through a series of tabs 138. Tabs 138 are received into a matching groove 142. In order to facilitate the securement of tabs 138 into grooves 142 a polymer resin is adhered to both tabs 138 and grooves 142. In addition, several layers of laminates, either polymer, fiberglass or a combination thereof is spread over the entire surface of boards 112 and 114.

In the preferred embodiment, the radius of curvature of the corners of outer portions 112*a* and 114*a* is approximately 5.74 cms. The radius of curvature of the corners of inner portions 112*c* and 114*c* are approximately 1.94 cms.

In addition, outer or front portions 112*a* and 114*a* are curved upwardly to achieve a height of up to 71 mm from the bottom surface of snowboard 110. In accordance with the invention it has been found that the most preferred range for the height of the front portions 112*a* and 114*a* is from 4.0 cms to 7.0 cms, although, heights as great as 71 mm appears to function well on the basis of experience to date. Similarly, inner or rear portions 112*c* and 114*c* are curved upwardly to achieve a height of approximately 31 mm from the bottom of snowboard 110.

Additionally, the overall dimensions of sections 112 and 114 are approximately: length 77.7 cms; width 29.8 cms; front radius 14.9 cms; rear corner radius 3.2 cms; radius of upward curve of front portions 23.3 cms; and radius of rear upward curve of rear portions 9.9 cms.

Figure 21:
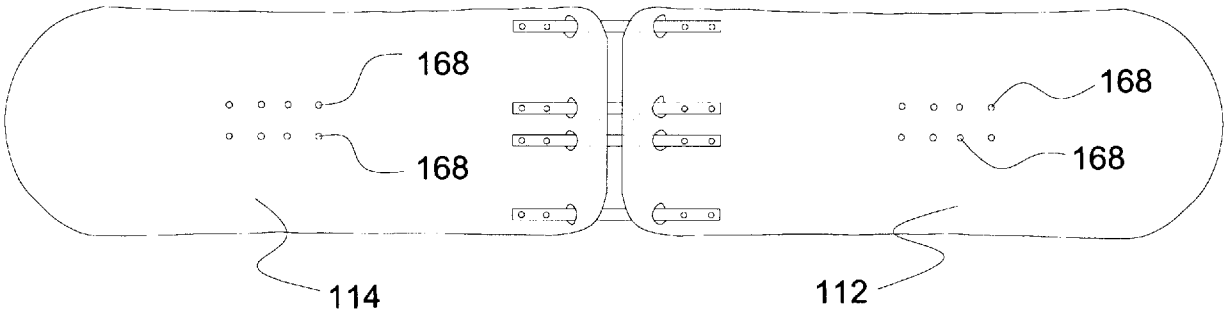
FIG. 21 is a top plan view of the present invention.
Figure 22:
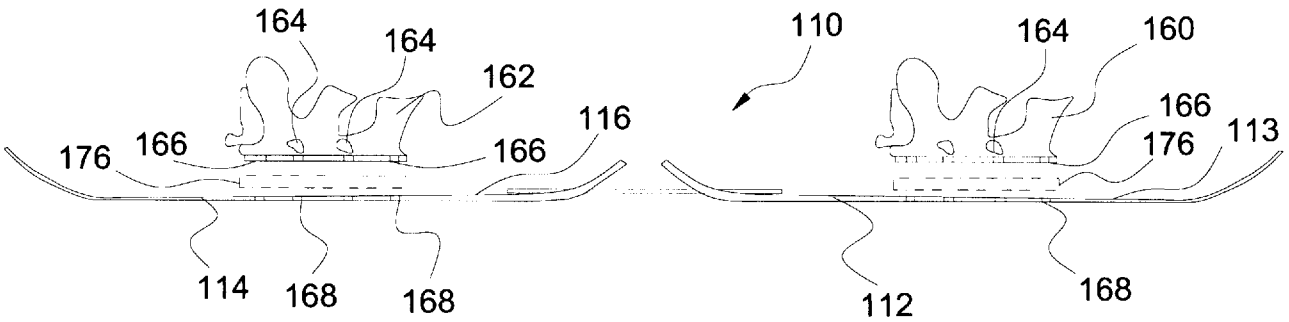
FIG. 22 is a side view illustrating the binding securement of the present invention.

Referring now to FIGS. 21 and 22, the user's securement of the structure is illustrated. Typically, a conventional snowboard has a pair of bindings 160 and 162. Bindings 160 and 162 are of conventional design and are configured to be strapped to a user's foot or to allow them to engage a step in binding system.

In accordance with similar technology or improvements thereof, the present invention utilizes typical snowboard bindings with one binding being secured to front section 112 and the other being secured on rear section 114.

Securement of bindings 160 and 162 is provided by bolts 164. Bolts 164 pass through openings 166 and into threaded openings 168 provided in upper surfaces 113 and 116. Threaded openings 168 are provided in accordance with the similar technology utilized for threaded openings 127. This similarity is of particular importance when snowboard 110 is being mass produced.

Alternatively, and as illustrated by the dashed lines in FIG. 22, a receiving plate 176 may be mounted to the upper surfaces 113 and 116. Receiving plate may be configured with a quick release structure that worlds in cooperation with a securement device secured to the bottom of the boot of a user. Such a structure may comprise a magnetic securement or detachable release mechanism secured to the user's boot and the surface of the snow board. Such a securement system may be affixed to either snowboard section or both.

Figure 23:
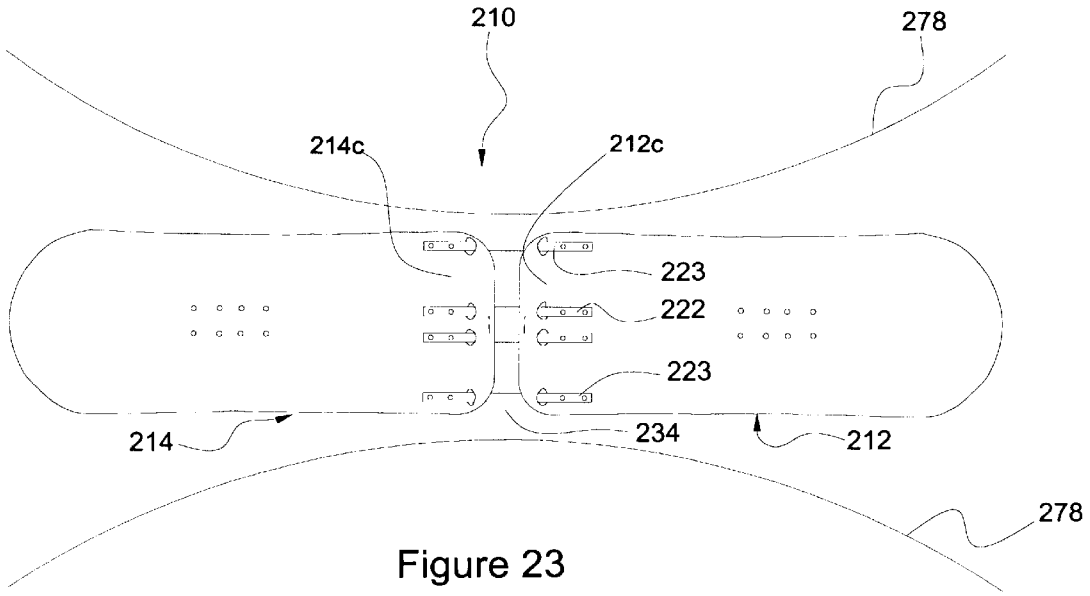
FIG. 23 is a top plan view of an alternative embodiment of the present invention.

Referring now to FIG. 23, an alternative embodiment of the present invention is illustrated. Here the rear portions 212*c* and 214*c* are provided with a more radical curve along the periphery of portions 212*c* and 214*c*. Here opening 234 is much larger and allows greater flexibility between sections 112 and 114. Thus, a user is able to flex snowboard 110 along a greater radius of curvature 278. The flexibility along this radius of curvature may also be enhanced or restricted by the flexibility of straps 222 and 223.

Figure 24:
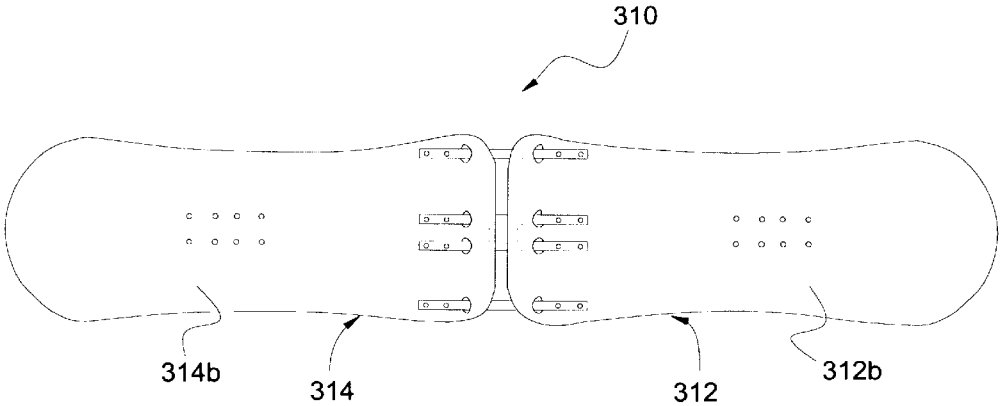
FIG. 24 is a top plan view of an alternative embodiment of the present invention.

Referring now to FIG. 24, another alternative embodiment of the present invention is illustrated. Here the mid-portions 312*b* and 314*b* are provided with a more radical curve along the periphery of portions 112*b* and 114*b* of the FIG. 13 embodiment. Here the curve along mid-portions 312*b* and 314*b* allows the user to more easily carve a series of S turns.

Figure 25:
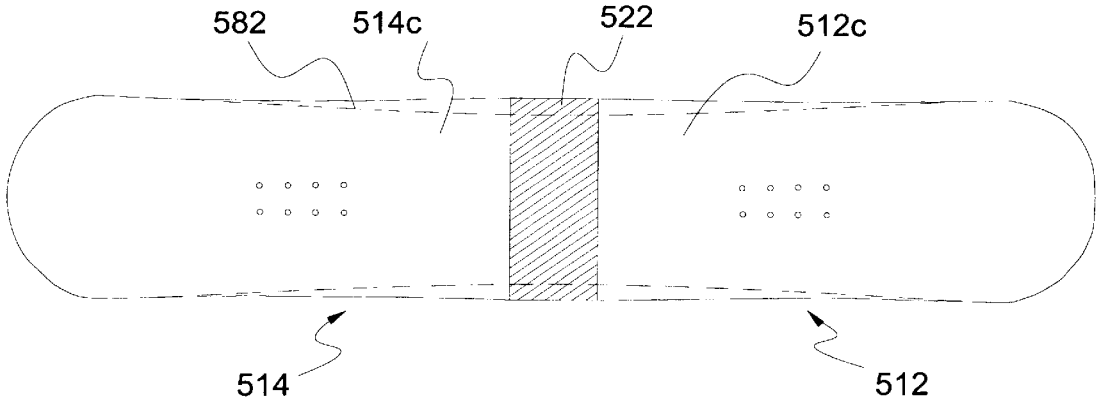
FIG. 25 is a top plan view of an alternative embodiment of the present invention.
Figure 26:
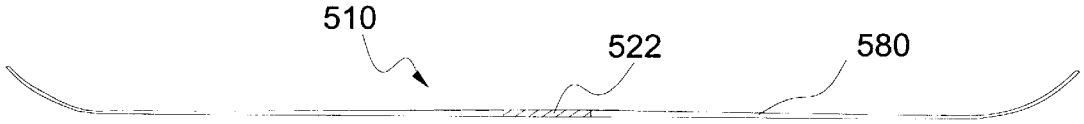
FIG. 26 is a side view of FIG. 25 embodiment.

Referring now to FIG. 25, yet another alternative embodiment of the present invention is illustrated. Here the sections 512 and 514 are secured to each other by a flexible connector 522. Flexible connector 522 is molded into portions 512*c* and 514*c*. Alternatively, flexible connector 522 can replace portions 512*c* and 514*c* and be secured directly to sections 512*b* and 514*b*.

Flexible connector 522 allows snowboard 510 to resemble a conventional snowboard. However, connector 522 also allows snowboard 510 to have a greater range of mobility, such as depicted by snowboard 110 and as illustrated in FIGS. 15–19.

Alternatively, and as illustrated by dashed lines, snowboard 510 may be provided with a more radical curve along the sides 580 and 582 of portions 512 and 514. Here the width of connector 522 would be shorter and the curve along portions 512 and 514 allow the user to more easily carve a series of S turns.

Figure 27:
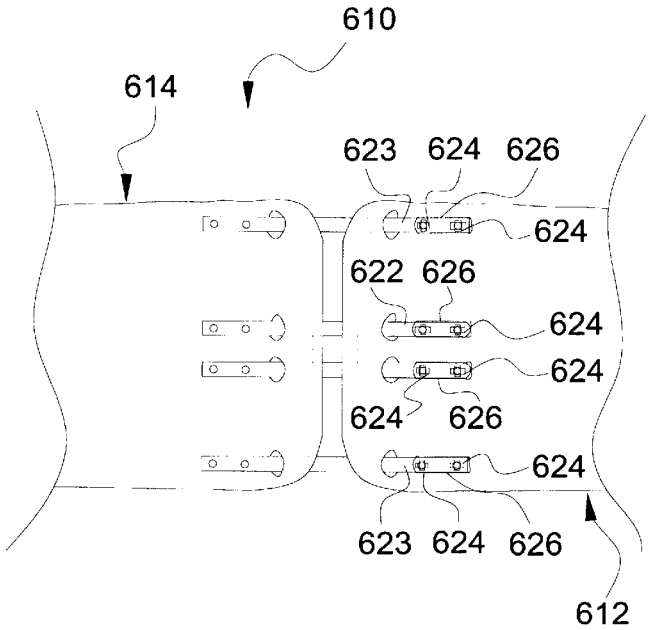
FIG. 27 is a top plan view of yet another alternative embodiment of the present invention.

Referring now to FIG. 27, yet another alternative embodiment of present invention is illustrated. Here straps 622 and 623 include a structure for quick-detachment and quick-attachment of the sections 612 and 614. In FIG. 27, a metal connecting plate 626 is secured to the upper surface of straps 622 and 623. Plate 626 and straps 622 and 623 are secured to snowboard 610 by a plurality of turnbuckles 624.

Turnbuckles 624 pass through a plurality of elongated openings 625. Turnbuckles 624 are then rotated 90 degrees to prevent turnbuckles 624 from passing through openings 625. This configuration allows straps 622 and 623 to easily removed and/or secured to section 612.

OBJECTIVES AND ADVANTAGES

The preferred embodiment and various modifications thus described clearly shows the advantages of the articulated two-section snowboard. First of all, in downhill movement, it will be clear in the irregularity of the terrain, the engagement of surface with this variation of the articulated two-section snowboard will be facilitated because it is not dependent on the inflexibility of a monolithic snowboard.

It is clear, that at all times, regardless of the terrain conditions, this articulated two-section snowboard will provide better surface to ground contact, allowing the snowboarder greater control and agility. In addition to all this, in the filed of acrobatic or stunt snowboarding, a new dimension is opened, whereby the snowboard, in the air or on the surface, can be articulated in various free form style displays.

Figure 12:
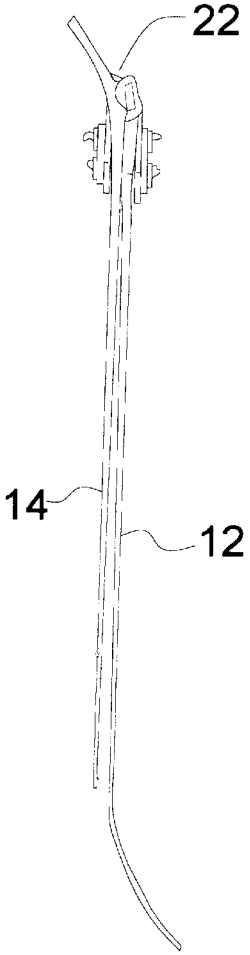
FIG. 12 is a side view of an articulated two-section snowboard, as shown in FIG. 1, folded for compact storage or transport.

In storage and transport, because the articulated two-section snowboard can be folded as shown in FIG. 12, the snowboard occupies less space in a vehicle, closet or storage area. The hinge-like articulated two-section snowboard will accommodate the snowboarder and co-occupant on a chair lift, whereas previous snowboards, due to the rigidity, tended to angle into the space of the co-occupant. This current invention allows the articulated two-section snowboard to simply hang off of the foot bar of the chair lift, preventing interference and annoyance of both snowboarder and co-occupant when being transported on a chair lift.

Another cumbersome feature to the prior rigid snowboards is once a user reaches the bottom of a slope or a flat surface, forward movement is nearly impossible. In the embodiment utilizing a quick-connect and disconnect feature, the user can simply disconnect the snowboard sections. Then the user would simply ski, utilizing the two-sections, now separate. The benefits of the articulated two-section snowboard are numerous.

While the above-mentioned specifications are directed to a snowboard, it should be clear that the same structure and characteristic can be used for alternative mediums such as water, land and air. As a sole water ski, the present invention has many of the same benefits that can be utilized on a surface of water. The invention can also accommodate the same principals that previous skateboards contain with the structure of this invention relating the two sections. The same can apply for the apparatus utilized in air acrobatics.

Thus, while the articulated two-section snowboard has been shown, it is not limited, but of a scope defined by the following claim language which may be broadened by an extension of the right to exclude others from making, using or selling the invention as is appropriate under the doctrine of equivalents.

While an illustrative embodiment of the invention has been described, various modifications will be obvious to those skilled in the art. Such modifications are within the spirit and scope of the present invention which is limited and defined only by the appended claims.

We claim:

1. A sports board for movement along a surface, comprising:

(a) a first section having an upper surface, a lower surface, an outer end and an inner end, said outer end being upwardly curved to facilitate movement of said first section over said surface in a first direction;

(b) a second section having an upper surface, a lower surface, an outer end and an inner end, said outer end being upwardly curved to facilitate movement of said second section over said surface in a second direction;

(c) a flexible connector for connecting said inner end of said first section to said inner end of said second section, said flexible connector being capable of twisting and being flexible in both a horizontal and vertical direction;

(d) a first binding for securing one of the user's feet to the upper surface of said first section, said first binding being fixedly secured to said first section: and (e) a second binding for securing the other foot of the user to the upper surface said second section, said second binding being fixedly secured to said second section whereby said user is able to facilitate the movement of said sports board in either said first or said second direction.

2. A sports board as claim 1, wherein said sports board is a snowboard.

3. A sports board as claim 1, wherein one of said pair of bindings is removably secured to one of said sections.

4. A sports board as claim 1, wherein said inner ends of said sections are upwardly curved, said curvature of said inner ends having a radius of curvature smaller than the radius of curvature of said outer ends.

5. A sports board as in claim 1, wherein said connector is secured to the upper surface of said sections.

6. A sports board as in claim 5, wherein said connector is removably secured to said sports board.

7. A sports board as in claim 5, wherein said connector passes through an opening in said inner end of said first section and an opening in said inner end of said second section.

8. A sports board as in claim 1, wherein said first and second sections each have a mid section positioned between said inner and outer ends and said mid-sections are constructed from a plurality of wood laminates.

9. A sports board as in claim 8, wherein said outer and inner sections are constructed from an acrylonitrile butadiene strene resin.

10. A sports board as in claim 9, wherein said mid-sections have a greater thickness proximate to said inner ends.

11. A sports board as in claim 1, wherein the periphery of said first and second sections between said inner and outer ends defines an edge on either side of said sections, said edges being configured, dimensioned and positioned to engage said surface and to facilitate lateral movement of said sports board.

12. A sports board as in claim 11, wherein said edges are curved inwardly.

13. A sports board as in claim 1, wherein said flexible connector comprises:

i) a first connector positioned for connecting said inner end of said first section to said inner end of said second section; and ii) a pair of connectors positioned on either side of said first connector and for connecting the inner end of said first section to said inner end of said second section.

14. A sports board as in claim 13, wherein said first connector is configured to have a pair of connecting portions extending outwardly from either side of said first connector, said connecting portions connecting said inner end of said first section to said inner end of said second section.

15. A sports board as in claim 1, wherein said inner ends of said sections each have a pair of curved edges and said flexible connector connects said first section to said second section at a first distance between said inner ends of said sections and said curved edges of said first section is positioned at a second distance from said curved edges of said second section whereby said second distance is greater than said first distance and allows for a greater range of mobility of said first section with respect to said second section.

16. A sports board as in claim 1, wherein the periphery of said sports board between said outer end of said first section and said outer end of said second section is configured and dimensioned to define a curve on both sides of said sports board, said curve beginning at said outer end of said first section and ending at said outer end of said second section.

17. A sports board as claim 1, wherein said flexible connector is integral with said first and second sections.

18. A sports board as in claim 17, wherein said upper and lower surfaces of said first and section sections are defined by a periphery which defines a curved outer end, a curved inner end and a pair of edges for engaging said surface, said edges being positioned along the sides of said sections and extending between said inner and outer ends, said outer ends being upwardly curved to facilitate movement of said sections over said surface.

19. A sports board as in claim 1, wherein said flexible connector is mounted to the upper surface of said sections.

20. A sports board as in claim 19, wherein said inner ends are curved along each said periphery of said sections, said curve being positioned at a point where said inner ends meet said edges, said curved inner ends allowing for greater lateral movement of said first section with respect to said second section.

21. A sports board as in claim 1, wherein said flexible connector is at least as wide as said inner sections and is integral with said inner sections.

22. A sports board as in claim 21, wherein said sports board is configured to have a pair of curved edges along the periphery of said sports board, said edges extending between said outer end of said first section and said outer end of said second section, said edges being configured, dimensioned and positioned to have a greatest point of curvature at a point where said flexible connector connects said first section to said second section and to engage said surface and to facilitate the lateral movement of said first section with respect to said second section.

23. A snowboard comprising a first section, a second section, a flexible connector for flexibly connecting said sections together, and a binding for one foot mounted on each section, wherein the second section has an upwardly curved tip, wherein the upwardly curved tip of the second section is formed with an opening dimensioned to pass said flexible connector therethrough, wherein one end of said flexible connector is secured to said second section and wherein the other end of the flexible connector passes through the opening formed in said second section and is secured to said first section.

24. A snowboard for movement along a surface, comprising:

(a) a first section having an upper surface adapted to be engaged by a user, a lower surface adapted to move along said surface, and an outer end and an inner end, said outer end being upwardly curved to facilitate movement of said first section over a surface; and (b) a second section having an upper surface, a lower surface adapted to move along said surface, and an outer end and an inner end, said outer end being upwardly curved to facilitate movement of said first section over a surface;

(c) a flexible connector connecting said inner end of said first section to said inner end of said second section, said flexible connector allowing for twisting and movement in both the horizontal and vertical planes; and (d) a binding for one foot fixedly secured to each section.

* * * * *